United States Patent [19]

Beinhaur

[11] Patent Number: 4,764,131

[45] Date of Patent: Aug. 16, 1988

[54] ELECTRICAL CONNECTOR

[75] Inventor: Ernest L. Beinhaur, Harrisburg, Pa.

[73] Assignee: AMP Incorporated, Harrisburg, Pa.

[21] Appl. No.: 72,815

[22] Filed: Jul. 13, 1987

[51] Int. Cl.[4] ..... H01R 4/44

[52] U.S. Cl. ..... 439/781

[58] Field of Search ..... 439/781–784, 439/786, 787, 791, 793, 794, 801, 805, 807, 810–815

[56] References Cited

U.S. PATENT DOCUMENTS

| | | | |
|---|---|---|---|
| 2,932,870 | 4/1960 | Williams | 439/781 |
| 2,963,679 | 12/1960 | Jugle | 439/781 |
| 3,012,091 | 12/1961 | Schiffmann | 439/781 |
| 3,733,575 | 5/1973 | Gottschalk et al. | 439/781 |
| 3,924,920 | 12/1975 | Moscioni et al. | 439/781 |
| 4,293,176 | 10/1981 | Lindlöf | 339/98 |
| 4,471,159 | 9/1984 | Frank, Jr. | 339/246 |

FOREIGN PATENT DOCUMENTS

| | | | |
|---|---|---|---|
| 715977 | 1/1942 | Fed. Rep. of Germany | 439/781 |
| 689182 | 3/1953 | United Kingdom | 439/781 |

*Primary Examiner*—Gil Weidenfeld
*Assistant Examiner*—Paula A. Austin
*Attorney, Agent, or Firm*—Allan B. Osborne

[57] ABSTRACT

An electrical connector for electrically connecting cables together. More particularly, the connector includes a body member being U-shaped to provide a central opening and having cable receiving grooves on each side of the opening. Further included is a cap member having a section which slides into the central opening and laterally extending arms which overlap the body member and have grooves facing and cooperating with the grooves in the body member to confine cables therebetween. The body and cap members can be assembled, disassembled, and reused.

13 Claims, 5 Drawing Sheets

ELECTRICAL CONNECTOR

FIELD OF THE INVENTION

This invention relates generally to electrical connectors of the type wherein two otherwise separate electrical cable are electrically joined by means of components forming the connector which cooperate to grip and compress the cable in parallel channels.

BACKGROUND OF THE INVENTION

Electrical connectors of the general type as the one disclosed herein include two members which are secured together with electrical cables located in parallel channels cooperatively formed by the members. One such connector is disclosed in U.S. Pat. No. 4,471,159 to Frank, Jr. This connector comprises a body member, a cap member and a pin having a head at one end and a knurled portion at the other end. Both members have grooves along each side and apertures therebetween which are normal to the grooves. Further, the aperture in the body member is undersized with respect to the knurled portion and the aperture in the cap member is oversized. Cables are placed on the body member grooves and the cap member placed thereover with the grooves thereon engaging the cables. The pin is then loosely inserted through the aperture in the cap member and forcefully driven into the aperture in the body member to secure to two members together with the cables compressed between the grooves. The knurled portion is bonded to the body member through cold welding so that a high, strong, reliable retention force is provided. The described methods for driving the pin include using an explosive, hydraulic or mechanical tool capable of delivering a high force. While the above described connector provides a reliable electrical connection, the assembly thereof requires a high force so the cold welding can occur. Further, the assembly once made can be disassembled only by destroying the connector. Further, although the laterally extending arms of the cap member will provide some resiliency to accommodate cable creep, the resiliency is in the form of physically deforming the arms. Should the cables be oversized or the material in the cap member not suitable, the elastic limits of the arms can be overcome and their resiliency greatly impaired.

It is now proposed to provide an electrical connector for electrically joining a pair of cables wherein the two members are joined by use of readily available hand tools and can be easily disassembled and reused. Further, the arms of the cap member can be deformed without exceeding the elastic limits thereof so that the resiliency thereof is preserved.

SUMMARY OF THE INVENTION

According to the invention, an electrical connector is provided which includes cooperating body and cap members. The body member has a space and cable receiving grooves on each side of the space. The cap member has arms which extend over the grooves on the body member to confine cables therebetween and further has a section which is received in the space.

DESCRIPTION OF THE INVENTION

Figure 1:
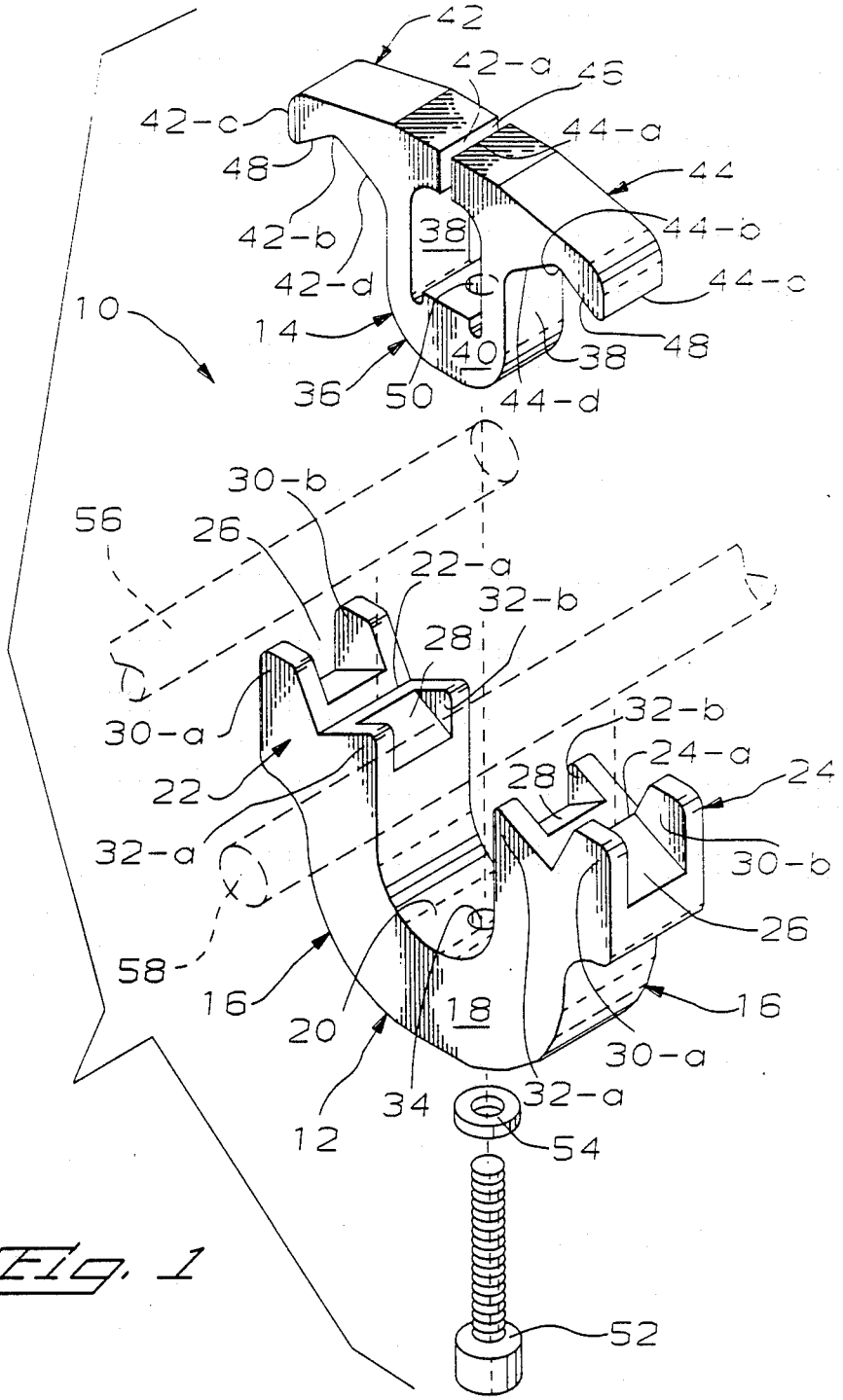
FIG. 1 is an exploded perspective view of an electrical connector of the invention.

With reference to FIG. 1, electrical connector 10 of the present invention includes body member 12 and cap member 14. As viewed from an end, body member 12 is generally U-shaped with legs 16 joined at one end by bight 18 to define a central opening or outwardly open space 20. Free end portions 22,24 of legs 16 are provided with V-shaped grooves **22-*a*, 24-*a* respectively. Notches 26,28, one on each side of each groove 22-*a*, 24-*a*, and normal thereto cut into portions to define opposing walls 30-*a*,30-*b* bracketing notches 26 and opposing walls 32-*a*,32-*b* bracketing notches 28. Threaded hole 34 extends through bight 20**.

Cap member 14 includes U-shaped section 36 defined by spaced apart legs 38 and bight 40. Arms 42,44, attached to the free ends of respective legs 38, extend laterally inwardly towards each other and laterally outwardly beyond section 36. Gap 46 separates inner free ends **42-*a*,44-*a* of arms 42,44 respectively. V-shaped grooves 42-*b*,44-*b*, provided on the under surface 48 of arms 42,44 respectively, are bracketed by outer free ends 42-*c*,44-*c* and beveled portions 42-*d*,44-*d* of arms 42,44 respectively. Threaded hole 50 extends through bight 40**.

Both body and cap members 12,14 respectively are made from a suitable material such as 6061 T6 aluminum. Space 20 of member 12 is sized to slidingly receive section 36 of member 14. Further, at least arms 42,44 of cap member 14 are thin enough to be received in notches 26,28 in the laterally projecting portions 22,24 of legs 18 of cap member 12.

Electrical connector 10 also includes bolt 52 which is threadedly received through hole 34 in bight 18 of member 12 and hole 50 in bight 40 of member 14. Alternatively, hole 34 could be oversized so that bolt 52 is freely received therethrough. Washer 54 may also be included if desired.

Electrical connector 10 is assembled by sliding section 36 of cap member 14 into space 20 of body member 12 and secured by bolt 52 extending through holes 34 and 50.

Electrical cables 56,58, shown in phantom in FIG. 1, are generally stranded and covered by insulation (not shown). Such insulation is removed prior to being electrically connected by connector 10.

Figure 2A:
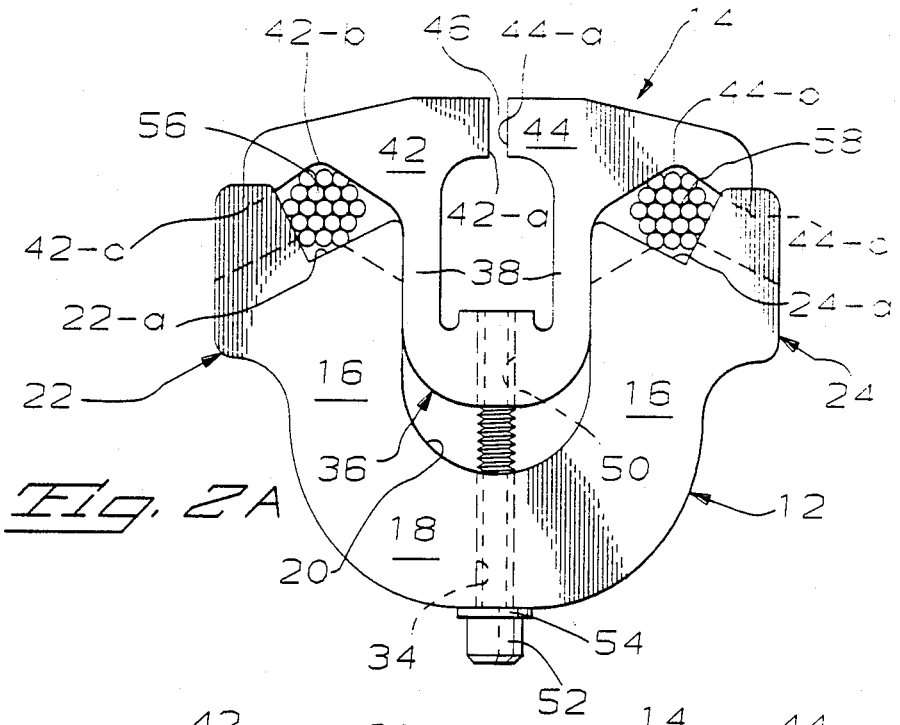
FIGS. 2A and 2B are end views illustrating the assembly of the electrical connector of FIG. 1.
Figure 2B:
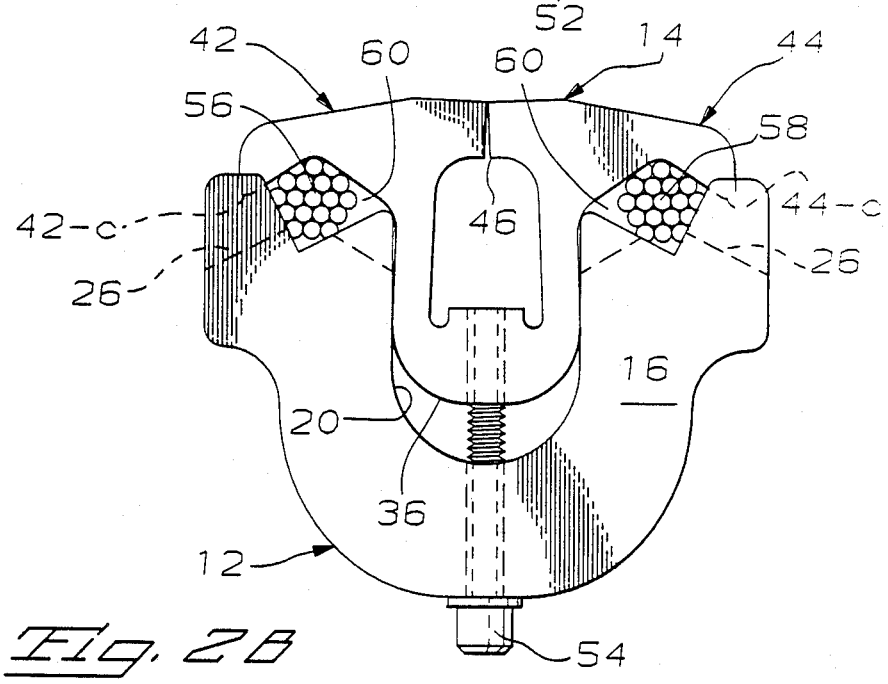

FIG. 2A,2B illustrate the electrical and mechanical joining of cables 56,58. Cap member 14 is loosely attached to body member 12 so that grooves **22-*a*,24-*a* on body member 12 are accessible. After cables 56,58 are placed in respective grooves 22-*a*,24-*a*, members 12,14 are drawn into tight engagement by turning bolt 52. As section 36 of cap member 14 is drawn into space 20 in body member 12, grooves 42-*b*,44-*b* engage respective cables 56,58 and arms 42,44, sliding over the cables, are forced inwardly, closing gap 46 as shown in FIG. 2B**. Two events occur as a consequence: the strands of cable 56,58 rub against each other to clean away debris and oxides and arms 42,44, by reason of being resiliently deformed, exert a continued pressure on cables 56,58 which are compressed in channels 60 (FIG. 2B) formed by opposing grooves 22-*a*,42-*b* and 24-*a*,44-*b* respectively. Free ends 42-*c*,44-*c* of arms 42,44 respectively are received in notches 26 and beveled portions 42-*d*,44-*d* may be received in notches 28 in cases where cables 56,58 are of small diameter.

As noted above, arms 42,44 are forced inwardly. It is to be understood that legs 38 are being moved also and that the motion is in an arc with the pivoting being at the point where legs 38 join bight 40.

Cables 56,58 may be quickly disengaged by loosening bolt 54 and removing the cables from channels 60. As noted above, connector 10 may be reused as no component or portion thereof is damaged or permanently deformed during use.

Figure 3A:
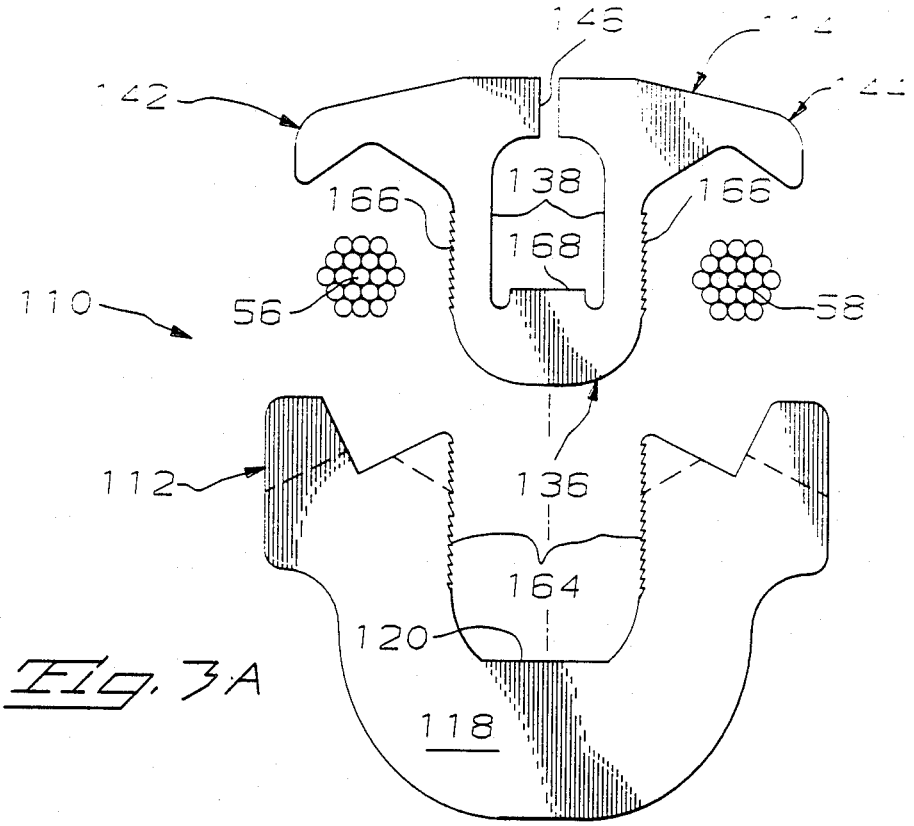
FIGS. 3A and 3B are views illustrating the assembly of another embodiment of an electrical connector of the present invention.
Figure 3B:
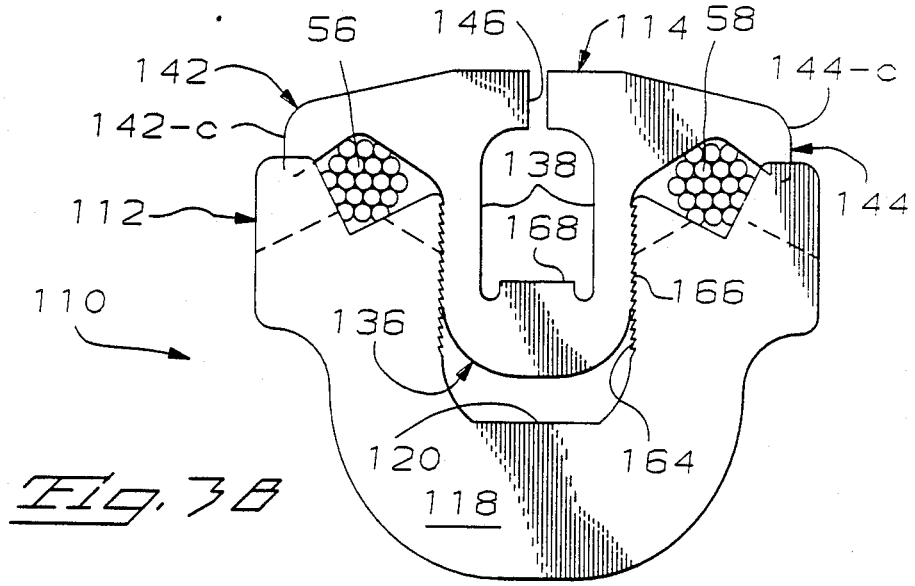

FIGS. 3A and 3B illustrate another embodiment of the present invention. Electrical connector 110 shown differs from connector 10 in the manner of securing the two members together. In this embodiment serrations or teeth 164 which are provided on the walls of space 120 point obliquely towards bight 118 of body member 112 and teeth 166 which are provided on the outer surfaces of section 136 of cap member 114 point obliquely towards arms 142,144. Bolt 54 and threaded holes 34,50 of electrical connector 10 are not used with connector 110. In all other respects connector 10 and connector 110 are alike. Members 112,114 are secured together by teeth 164,166 engaging each other as section 136 is driven into space 120 as shown in FIG. 3B. The two members 112,114 can be secured by the use of pliers (not shown), with the jaws bearing against the outer surface of bight 118 and on platform 168 located between legs 138 of member 114.

In this embodiment gap 146 must be wide enough so as not to close up during assembly. That is, to disassembly connector 110, compressive force is applied to free ends 142-*c*,144-*c* to move legs 138 towards each other so the teeth 64,66 disengage and member 114 can be withdrawn from member 112.

Figure 4:
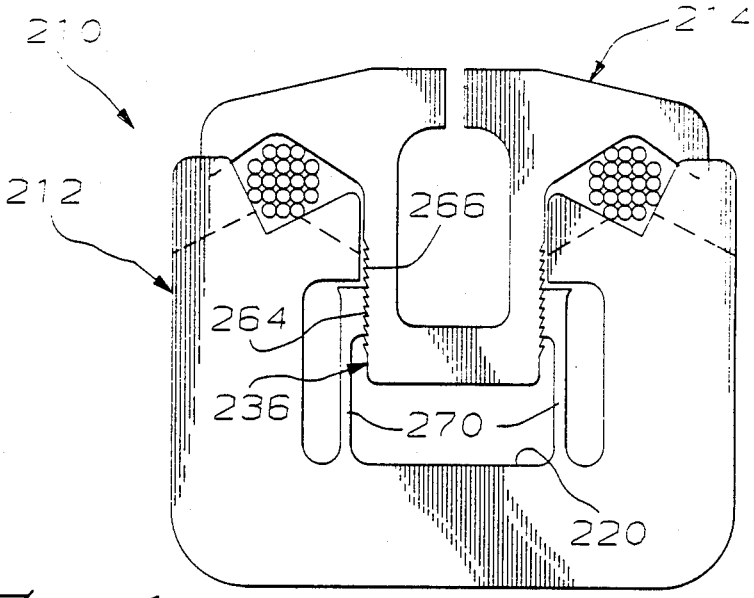
FIGS. 4 and 5 are end views illustrating two additional embodiments of an electrical connector of the present invention.
Figure 5:
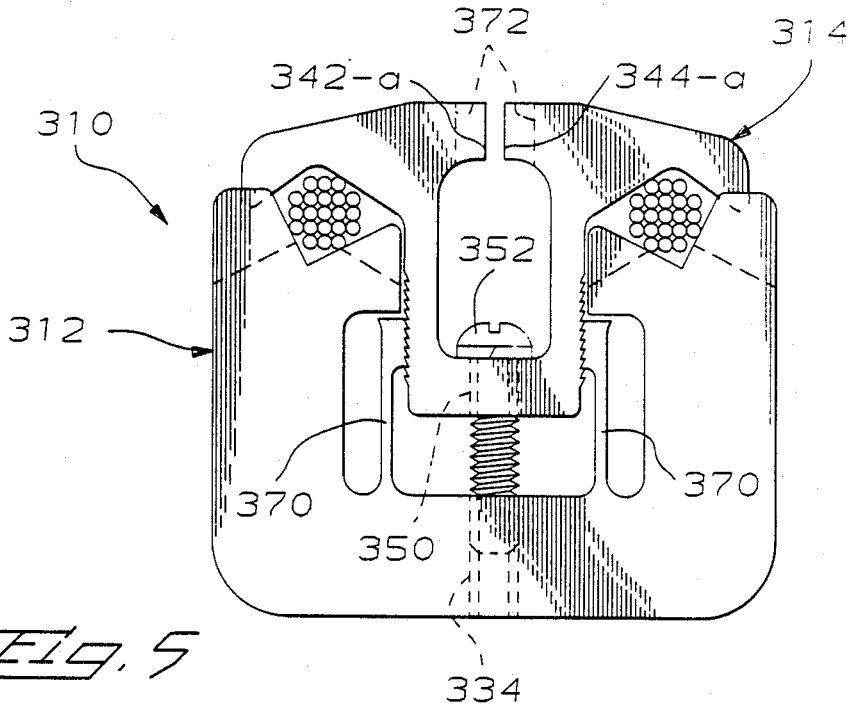

FIGS. 4 and 5 illustrates two other embodiment of the present invention. Electrical connector 210 shown in Figure 4 employs teeth 264 and 266 on members 212 and 214 respectively as does connector 110. The difference is that a pair of free standing walls 270 define cavity 220 in member 212. Walls 270 can be moved away from each other, both to receive and release section 236 on member 214. Naturally a substantial force is required to force walls 270 apart to insure a secure assembly.

Connector 310 is the same as connector 210 except for the addition of bolt 352 which is threadedly received in hole 334 and loosely received in hole 350 in respective members 312 and 314. Further an enlarged passage 372 is provided in inner ends 342-*a* and 344-*a* of arms 342,344 respectively in cap member 314. Passage 372 permits the passage of a screw driver (not shown) to turn bolt 352 to bring members 312 and 314 into assembly. Bolt 352 must be backed out first during disassembly before spreading walls 370 apart.

Figure 6A:
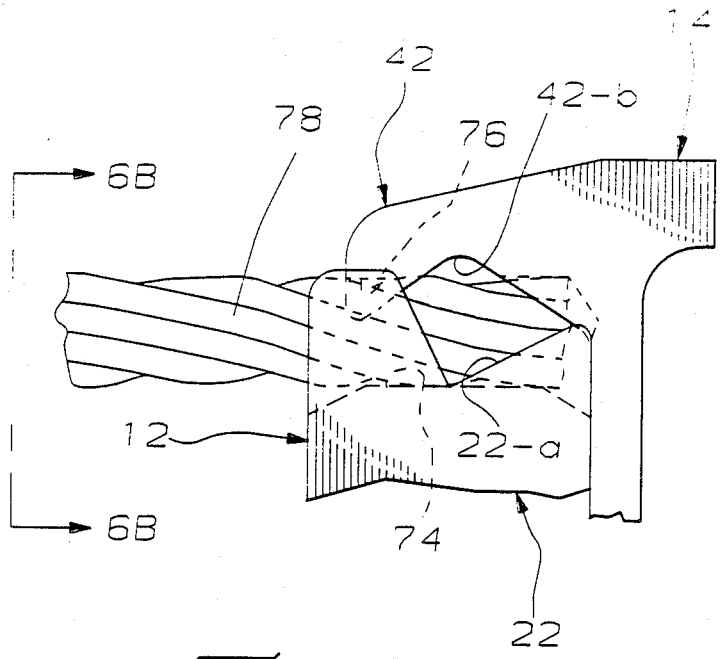
FIGS. 6A and 6B are end and side views respectively of a modification applicable to the electrical connectors of the present invention.
Figure 6B:
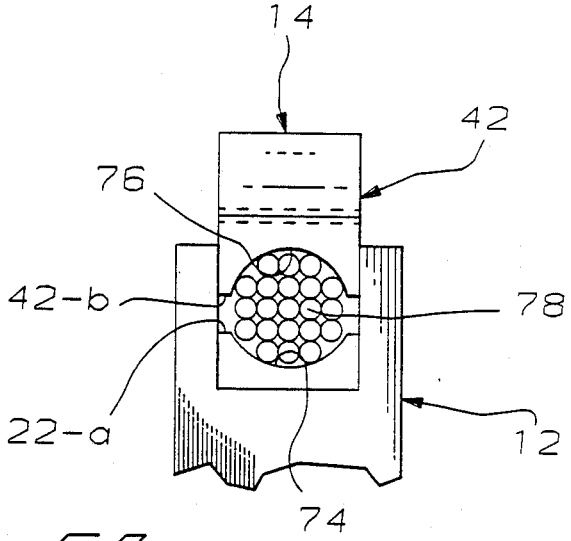

FIGS. 6A and 6B illustrate a modification applicable to the electrical connectors of the present invention. Laterally running arcuate grooves 74,76 cross respective grooves 22-*a*,24-*a* of member 112 and 42-*b*,44-*b* of member 14. This modification permits the electrical connecting and mechanical gripping of normally extending cable 78.

Throughout the foregoing description, reference has been made to electrical cable. It is to be noted however, that the electrical connector of the present invention can be made to accept cable and wire from the smallest to the largest diameters.

As can be discussed, an electrical connector for electrically and mechanically joining two cables has been disclosed. The connector includes a U-shaped base member having a groove on laterally extending free end portions of the legs and a cavity or outwardly opening space defined by the legs and bight. Further included is a cap member having grooves on laterally extending arms and an outwardly extending projection in between the arms. The connector is assembled by drawing the projection into the space so that the arms overlie the free end portions with the cables being compressed between opposing grooves in the respective free end portions and arms. In drawing the two members together, the arms on the cap member are resiliently moved in towards the center of the connector and according exert a continued compressive force on the cables to counteract any change in dimensions due to thermal factors. The connector may be dissembled and re-used without replacing any components thereof.

I claim:

1. An electrical connector for electrically connecting two cables, comprising:

body means having space means opening outwardly and groove means located on each side of said space means;

cap means for being assembled to said body means, said cap means having spaced-apart legs joined at one end to define a section adapted to be slidingly disposed in said space means and a pair of independent arm means each attached to a respective free end of said legs to laterally extend over said groove means to cooperate therewith to confine cables therebetween; and securing means for securing said body and cap means together.

2. The electrical connector of claim 1 wherein at least one of said groove means are positioned perpendicular relative to another one of said groove means.

3. The electrical connector of claim 1 wherein said arm means are resiliently biased against respective cables which may be in said groove means upon securing said body and cap means together.

4. The electrical connector of claim 3 wherein said arm means move in towards each other upon being resiliently biased against respective cables.

5. The electrical connector of claim 4 wherein aligned holes are provided in said body and cap means and said securing means include a bolt passing through and being threadedly received in at least one of said holes.

6. The electrical connector of claim 4 wherein said securing means include interlocking serrations on outer side surfaces of said legs of said section on said cap means and on inside surfaces of said space means in said body means.

7. An electrical connector for electrically connecting two cables, comprising:

U-shaped body means having an opening defined by spaced-apart, parallel legs joined at one end by a bight and further having cable receiving first grooves located on the free ends of said legs;

cap means positionable on said body means and having a U-shaped section, defined by spaced-apart, parallel legs joined at one end by a bight, receivable in said opening and a pair of independent arms extending laterally of said U-shaped section, said arms being attached intermediate inner and outer free ends thereof to respective legs with the inner free ends facing and spaced from each other, further each of said arms having second grooves which face and cooperate with said first grooves to confine cables therebetween; and releasable securing means for securing said body and cap means together.

8. The electrical connector of claim 7 wherein said body and cap means are assembled by said U-shaped section being drawn into said opening with said laterally extending arms being resiliently biased against respective cable which may be between respective first and second grooves.

9. The electrical connector of claim 8 wherein each joined arm and leg is resiliently movable in an arc so that upon being biased against the cable, said joined arm and leg move resiliently towards the other joined arm and leg.

10. An electrical connector for electrically connecting two cables, comprising:

a body member having parallel leg means joined at one end by bight means to define an outwardly open space and groove means in the free end surface of each leg means for receiving cables therein;

a cap member having a pair of independent arm means, a pair of leg means attached to each of said arm means intermediate the free ends and extending therefrom, bight means joining said leg means at the ends remote from said arm means, said leg and bight means defining insertion means for being inserted into said open space in said body member, said arm means having groove means which face and cooperate with said groove means on the body member to confine electrical cables therebetween; and securing means for securing said body and cap members together.

11. An electrical connector for electrically connecting two cables, comprising;

body means having a central opening defined by spaced-apart parallel first legs joined at one end by a first bight and first grooves in the free ends of said first legs;

cap means having a U-shaped member formed from a pair of parallel, spaced apart second legs joined at one end by a second bight, independent arm means attached to each second leg at an end remote from said second bight and extending relative to said U-shaped member and in opposite directions from each other and a second groove in each arm means, said cap means being adapted to be assembled to said body means with said U-shaped member being received in said central opening and said arm means overlapping said first legs with said second grooves facing and cooperating with said first grooves to confine cables therebetween; and securing means for securing said body and cap means together.

12. The electrical connector of claim 11 further including a pair of parallel, spaced apart wall means positioned in said central opening for receiving said U-shaped member therebetween.

13. The electrical connector of claim 12 wherein said securing means include interlocking serrations on outer side surfaces of said U-shaped member and on facing surfaces of said wall means.

* * * * *